US007423385B1

(12) United States Patent
Lavi

(10) Patent No.: US 7,423,385 B1
(45) Date of Patent: Sep. 9, 2008

(54) SYSTEM AND METHOD FOR CONTROLLING VOLTAGE ON DISCHARGE CAPACITORS WHICH CONTROL LIGHT ENERGY FROM FLASH LAMPS

(75) Inventor: Gabi Lavi, Raanana (IL)

(73) Assignee: Lite Touch Ltd., Kfar Sava (IL)

( * ) Notice: Subject to any disclaimer, the term of this patent is extended or adjusted under 35 U.S.C. 154(b) by 0 days.

(21) Appl. No.: 11/695,034

(22) Filed: Apr. 1, 2007

(51) Int. Cl.
*H05B 37/00* (2006.01)

(52) U.S. Cl. ..... 315/241 P; 315/241 R; 315/246; 315/239; 315/268; 607/88; 363/19; 363/23

(58) Field of Classification Search ..... 315/241 P, 315/241 R, 246, 227 R, 232, 239, 268, 275; 363/19, 23, 21.18; 607/80, 88, 90
See application file for complete search history.

(56) References Cited

U.S. PATENT DOCUMENTS 5,485,361 A * 1/1996 Sokal ..... 363/21.17
6,011,359 A * 1/2000 Days ..... 315/241 S
7,274,155 B2 * 9/2007 Inochkin et al. ..... 315/247
2006/0074468 A1 * 4/2006 Neev ..... 607/90
2007/0239144 A1 * 10/2007 Korenberg ..... 606/9

* cited by examiner

*Primary Examiner*—Haissa Philogene
(74) *Attorney, Agent, or Firm*—Dekel Patent Ltd.; David Klein

(57) ABSTRACT

A system and method are described for controlling voltage on discharge capacitors which control light energy from flash lamps, wherein the method includes measuring over time an operational behavior of a flash lamp for performing photo-thermolysis, wherein a discharge capacitor transfers energy to the flash lamp, empirically deriving a behavior of the flash lamp as a function of operation over time, and using the empirically derived behavior of the flash lamp to control a voltage of the discharge capacitor and thus energy transferred to the flash lamp.

13 Claims, 3 Drawing Sheets

SYSTEM AND METHOD FOR CONTROLLING VOLTAGE ON DISCHARGE CAPACITORS WHICH CONTROL LIGHT ENERGY FROM FLASH LAMPS

FIELD OF THE INVENTION

The present invention relates to photothermolysis, and particularly to a system and method for controlling voltage on discharge capacitors which control light energy from flash lamps, such as those used for skin treatments and/or permanent hair removal.

BACKGROUND OF THE INVENTION

All skin treatments based on light either with lasers or IPL (Intense Pulse Light) by thermolysis require delicate energy control in case to gain effective treatment without causing damage to the skin.

In commercial IPL systems, the energy is controlled either by controlling the pulse width of the light with very strong and expensive components or by means of energy measurements done with expensive components. The components that control the width of the pulse have to switch on and off the high voltage and the high current that operate the flash lamps. Usually the systems use IGBTs (Insulated Gate Bipolar Transistors) or MOSFETs (Metal-Oxide Semiconductor Field-Effect Transistors) for switching thousands of volts and amperes, and these components are big, expensive and very delicate in design. The thermal disc that measures the energy in order to control the energy is very expensive and must be cooled.

SUMMARY OF THE INVENTION

It is an object of the invention to provide a method for controlling energy in photothermolysis techniques that will allow the use of simple, small size and less expensive equipment.

There is thus provided in accordance with an embodiment of the present invention a system for controlling voltage including a flash lamp for performing photothermolysis, a discharge capacitor that transfers energy to the flash lamp, a power supply adapted to charge the discharge capacitor through a transformer, the transformer having a primary side and a secondary side, the discharge capacitor being connected to the secondary side of the transformer, circuitry for measuring voltage on one of the sides of the transformer and voltage of the power supply, and a controller adapted to control a voltage of the discharge capacitor and thus energy transferred to the flash lamp as a function of the voltage on one of the sides of the transformer and the voltage of the power supply.

The following are non-limiting features of embodiments of the invention. The circuitry for measuring voltage measures the voltage on the primary side of the transformer and the controller is adapted to control a reflected voltage of the discharge capacitor as a function of the voltage on the primary side of the transformer and the voltage of the power supply. The circuitry for measuring voltage may measure the reflection voltage of the discharge capacitor summed with the voltage of the power supply. The voltage on the transformer may be pulsed in accordance with a frequency of the power supply. The circuitry for measuring voltage may include a peak detector. A subtractor circuit may be provided to calculate the difference between the voltages of the two sides of the transformer. The circuitry for measuring voltage may sample the voltage on the secondary side of the transformer to which the discharge capacitor is connected.

The controller may control the energy transferred to the flash lamp so as to give the same energy output at each pulse of the power supply and to compensate for reduction of power of the flash lamp as operating time advances.

There is also provided in accordance with an embodiment of the present invention a method for controlling voltage including measuring over time an operational behavior of a flash lamp for performing photothermolysis, wherein a discharge capacitor transfers energy to the flash lamp, empirically deriving a behavior of the flash lamp as a function of operation over time, and using the empirically derived behavior of the flash lamp to control a reflected voltage of the discharge capacitor and thus energy transferred to the flash lamp.

The method may include charging the discharge capacitor with a power supply through a transformer, the transformer having a primary side and a secondary side, and the discharge capacitor being connected to the secondary side of the transformer, and further including controlling the reflected voltage of the discharge capacitor as a function of a voltage on the primary side of the transformer and the voltage of the power supply.

The method may include controlling the energy transferred to the flash lamp so as to give the same energy output at each pulse of the power supply and to compensate for reduction of power of the flash lamp as operating time advances.

The method may further include, when a voltage derived from the function reaches a predefined value, ceasing charging the discharge capacitor and then firing a pulse of light from the flash lamp.

BRIEF DESCRIPTION OF THE DRAWINGS

These and additional constructional features and advantages of the invention will be more readily understood in the light of the ensuing description of embodiments thereof, given by way of example only, with reference to the accompanying drawings wherein.

DETAILED DESCRIPTION OF EMBODIMENTS

Figure 1:
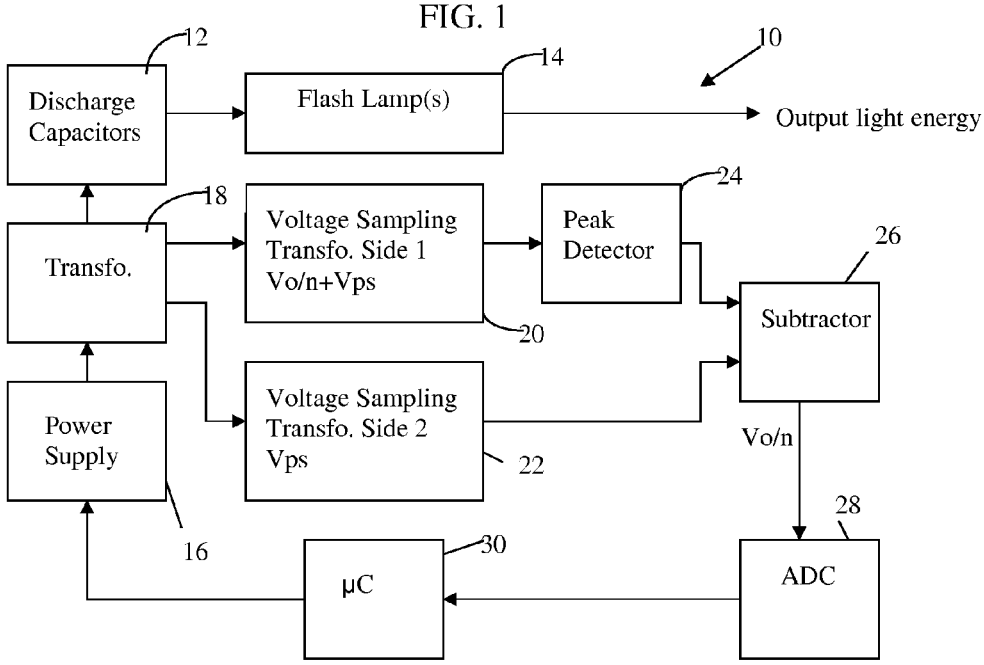
FIG. 1 is a simplified block diagram of a system for controlling voltage on discharge capacitors which control light energy from flash lamps, in accordance with an embodiment of the present invention.

Reference is now made to FIG. 1, which illustrates a system 10 for controlling voltage on one or more discharge capacitors 12 which control light energy from flash lamps 14, in accordance with an embodiment of the present invention. The flash lamp 14 may be a xenon flash lamp, but the invention is not limited to this. Flash lamp 14 may comprise a combination of single or dual flash lamps packaged as a flash lamp head in a housing with an optical reflector and filter that aim light energy onto tissue.

The light spectrum of xenon flash lamp 14 is a function of current through the lamp, as is well known. The energy to flash lamp 14 is transferred from one or more discharge capacitors 12. The more energy on the discharge capacitors 12 the more current through the flash lamp 14 and the more output light energy. The performance of flash lamp 14 degrades over time, meaning more electrical energy is required to get the same light output energy as the operating life of flash lamp 14 advances.

The voltage on the discharge capacitors 12 must be controlled in order to control the electrical energy on the discharge capacitors 12. The electrical energy on the discharge capacitors 12 is given as:

$E=0.5CV^2$ wherein E is the electrical energy on the discharge capacitors 12, V is the voltage on the discharge capacitors 12 and C is the capacitance. C is generally constant, so the energy is proportional to the square of the voltage on the capacitors 12.

A power supply 16 may charge the discharge capacitors 12 through a transformer 18. Measuring the voltage on the primary side of transformer 18 gives a reflection of the voltage on the discharge capacitors 12 which are in the secondary of transformer 18.

One side of transformer 18 is the reflection voltage summed with the voltage of power supply 16 (indicated by box 20) while the other side is only the voltage of power supply 16 (indicated by box 22). A difference between the two voltages gives the reflection of the capacitor voltage. Power supply 16 preferably includes an oscillator and the voltage on the transformer 18 is pulsed in accordance with the frequency of the oscillator of power supply 16. A peak detector 24 may be used to measure the maximum of the pulse which is the reflected voltage on the capacitors 12. A subtractor circuit 26 subtracts the power supply voltage from the voltage output by the peak detector 24.

The output voltage of the electrical circuit is fed to an ADC (Analog to Digital Converter) 28 and to a microcontroller 30 for further processing.

Calculation of the voltage measures:

One side of the primary of the transformer 18:

$$V1=Vps+Vo/n$$

Vps—voltage of power supply 16

Vo—voltage on discharge capacitors 12 on secondary of transformer 18 n—winding ratio of transformer 18

Subtractor circuit 26 performs Vps+Vo/n−Vps

Accordingly, the voltage at ADC 28 is given by:

$$Vadc=Vps+Vo/n-Vps=Vo/n$$

Vo/n is the reflected voltage of the discharge capacitors 12. Controlling Vo/n by means of microcontroller 30 thus controls the discharge capacitors voltage, which in turn controls the light energy of flash lamp(s) 14.

Figure 2:
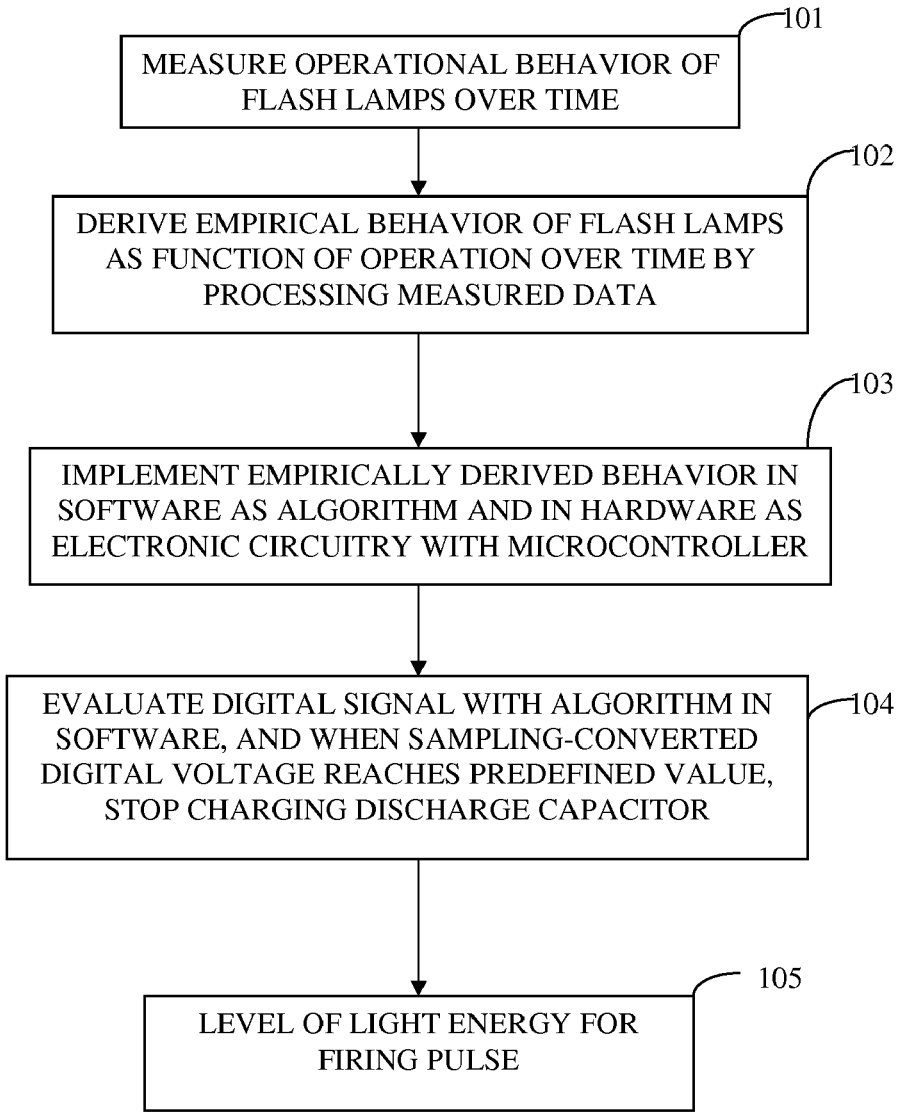
FIG. 2 is a simplified flow chart of a method for controlling voltage on discharge capacitors which control light energy from flash lamps, in accordance with an embodiment of the present invention.

In accordance with an embodiment of the present invention, the energy is controlled to give the same energy output at each pulse and to compensate for reduction of power of the flash lamps as the operating time advances, as is now explained with reference to FIG. 2.

The operational behavior of the flash lamps over time is measured (step 101), and an empirically derived behavior of the flash lamps as a function of operation over time is obtained by processing the measured data (step 102). (It is noted that the degradation of flash lamp performance is not linear and increases more rapidly as time goes on.) In this manner, a very good statistic of the life time behavior of the flash lamps is obtained as a function of mode of operation. The empirically derived behavior may be implemented in software as an algorithm and in hardware as electronic circuitry with microcontroller (μC) 30 (step 103).

The system first gets the analog voltage input and the μC 30 receives it as a digital signal converted by ADC 28. The digital signal then goes into the algorithm in the software for evaluation, and when the sampling-converted digital voltage reaches a predefined value the system stops charging the discharge capacitor (step 104). This is the level of light energy at which the system fires a pulse (step 105).

The designed voltage may be different for each flash lamp head (e.g., due to fluctuations in flash lamps), so preferably the initial value is burned in each head. The algorithm then controls the voltage behavior for all flash lamps.

Figure 3:
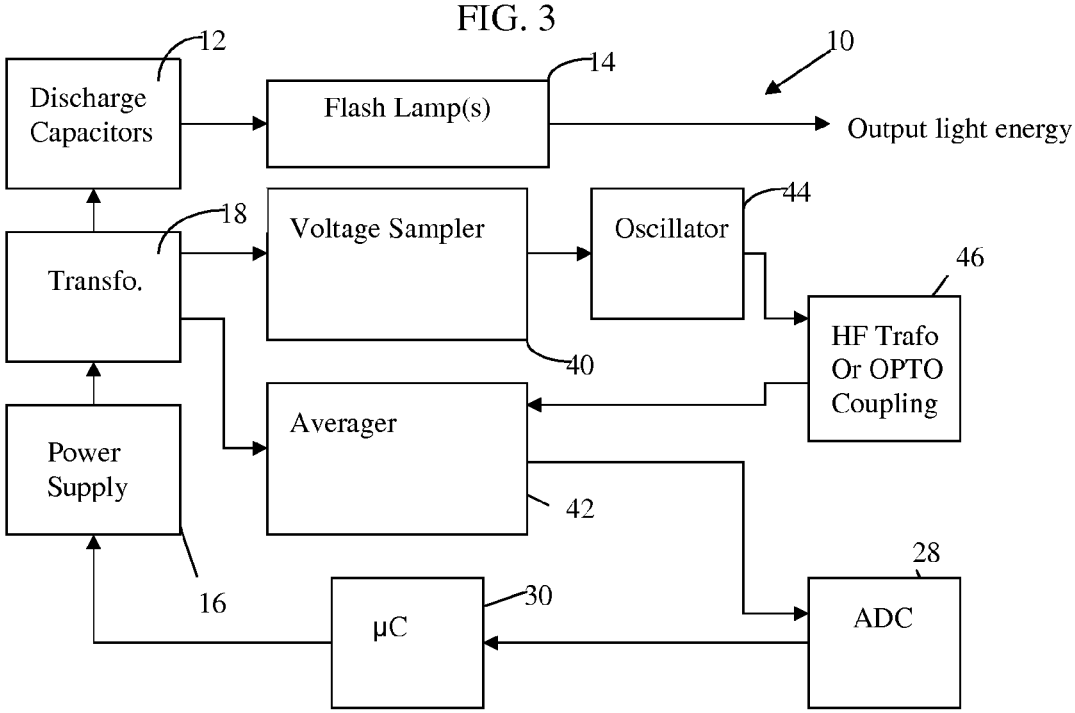
FIG. 3 is a simplified block diagram of a system for controlling voltage on discharge capacitors which control light energy from flash lamps, in accordance with another embodiment of the present invention.

Another option to bring the voltage measurement from the discharge capacitor to the microcontroller 30 is now described with reference to FIG. 3, which is a variation of the embodiment shown in FIG. 1. In the embodiment of FIG. 1, the reflected voltage on the discharge capacitor 12 is calculated, whereas in the embodiment of FIG. 3, the voltage on the discharge capacitor 12 is sampled.

The (high) voltage on discharge capacitor 12 may be measured (sampled) by a voltage sampler 40. The sampled voltage, which is a DC voltage and is related to the secondary of the transformer 18, may be oscillated by an oscillator 44 with high frequency (e.g., 0.1-10 MHz) and transferred through a HF (High Frequency) transformer or OPTO Coupling 46 to the primary of the transformer 18 that includes the μC 30. In a preferred embodiment, the oscillated sampling voltage from the discharge capacitor 12 is filtered, averaged by an averager 42 to get the average voltage, and transferred to μC 30 via ADC 28.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A system for controlling voltage comprising:

a flash lamp for performing photothermolysis;

a discharge capacitor that transfers energy to said flash lamp;

a power supply adapted to charge said discharge capacitor through a transformer, said transformer having a primary side and a secondary side, said discharge capacitor being connected to the secondary side of said transformer;

circuitry for measuring voltage on one of the sides of said transformer and voltage of said power supply; and a controller adapted to control a voltage of said discharge capacitor and thus energy transferred to said flash lamp as a function of the voltage on one of the sides of said transformer and the voltage of said power supply.

2. The system according to claim 1, wherein said circuitry for measuring voltage measures voltage on the primary side of said transformer and said controller is adapted to control a reflected voltage of said discharge capacitor as a function of the voltage on the primary side of said transformer and the voltage of said power supply.

3. The system according to claim 1, wherein said circuitry for measuring voltage measures a reflection voltage of said discharge capacitor summed with the voltage of said power supply.

4. The system according to claim 1, wherein the voltage on said transformer is pulsed in accordance with a frequency of said power supply.

5. The system according to claim 1, wherein said circuitry for measuring voltage comprises a peak detector.

6. The system according to claim 1, comprising a subtractor circuit adapted to calculate the difference between the voltages of the two sides of said transformer.

7. The system according to claim 1, wherein said controller controls the energy transferred to said flash lamp so as to give the same energy output at each pulse of said power supply and to compensate for reduction of power of said flash lamp as operating time advances.

8. The system according to claim 1, wherein said circuitry for measuring voltage samples the voltage on the secondary side of said transformer to which said discharge capacitor is connected.

9. A method for controlling voltage comprising:

measuring over time an operational behavior of a flash lamp for performing photothermolysis, wherein a discharge capacitor transfers energy to said flash lamp;

empirically deriving a behavior of said flash lamp as a function of operation over time; and using the empirically derived behavior of said flash lamp to control a voltage of said discharge capacitor and thus energy transferred to said flash lamp.

10. The method according to claim 9, comprising charging said discharge capacitor with a power supply through a transformer, said transformer having a primary side and a secondary side, and said discharge capacitor being connected to the secondary side of said transformer, and further comprising controlling a reflected voltage of said discharge capacitor as a function of a voltage on the primary side of said transformer and the voltage of said power supply.

11. The method according to claim 9, comprising controlling the energy transferred to said flash lamp so as to give the same energy output at each pulse of said power supply and to compensate for reduction of power of said flash lamp as operating time advances.

12. The method according to claim 9, further comprising, when a voltage derived from said function reaches a predefined value, ceasing charging said discharge capacitor and then firing a pulse of light from said flash lamp.

13. The method according to claim 9, comprising charging said discharge capacitor with a power supply through a transformer, said transformer having a primary side and a secondary side, and said discharge capacitor being connected to the secondary side of said transformer, and further comprising controlling the voltage of said discharge capacitor as a function of a voltage on the secondary side of said transformer to which said discharge capacitor is connected and the voltage of said power supply.

* * * * *